US010670996B2

(12) United States Patent
Hashimoto et al.

(10) Patent No.: US 10,670,996 B2
(45) Date of Patent: Jun. 2, 2020

(54) IMAGE FORMING APPARATUS HAVING MULTIPLE IMAGE FORMING UNITS

(71) Applicant: FUJI XEROX CO., LTD., Tokyo (JP)

(72) Inventors: Keita Hashimoto, Kanagawa (JP); Yukihiro Ichiki, Kanagawa (JP); Masaki Suto, Kanagawa (JP); Akira Shimodaira, Kanagawa (JP); Toshihiro Goda, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/362,700

(22) Filed: Mar. 25, 2019

(65) Prior Publication Data

US 2020/0096915 A1 Mar. 26, 2020

(30) Foreign Application Priority Data

Sep. 25, 2018 (JP) ..... 2018-178349

(51) Int. Cl.
*G03G 15/01* (2006.01)
*G03G 15/16* (2006.01)

(52) U.S. Cl.
CPC ..... *G03G 15/1615* (2013.01); *G03G 15/0189* (2013.01); *G03G 2215/00156* (2013.01); *G03G 2215/0158* (2013.01)

(58) Field of Classification Search
CPC ..... G03G 15/0152; G03G 15/0178; G03G 15/0189; G03G 15/0194
USPC ..... 399/298, 299, 302
See application file for complete search history.

(56) References Cited

U.S. PATENT DOCUMENTS

| | | | | |
|---|---|---|---|---|
| 7,450,894 | B2 * | 11/2008 | Matsumoto | G03G 15/0194 399/302 |
| 7,463,835 | B2 | 12/2008 | Harumoto | |
| 7,937,014 | B2 | 5/2011 | Kawamata | |
| 8,594,543 | B2 * | 11/2013 | Krucinski et al. | G03G 15/5058 399/301 |
| 8,682,233 | B2 | 3/2014 | deJong et al. | |
| 8,918,039 | B2 | 12/2014 | Krikawa et al. | |
| 9,835,982 | B2 * | 12/2017 | Josiah et al. | G03G 15/0178 |

FOREIGN PATENT DOCUMENTS

| | | |
|---|---|---|
| JP | 2007304192 | 11/2007 |
| JP | 2007310226 | 11/2007 |
| JP | 2014059391 | 4/2014 |

* cited by examiner

*Primary Examiner* — William J Royer
(74) *Attorney, Agent, or Firm* — JCIPRNET

(57) ABSTRACT

An image forming apparatus includes: a first forming unit that forms a superimposed toner image, in which yellow, magenta, and cyan toner images are superimposed on one another, on a first intermediate transfer unit; a second forming unit that is located downstream of the first forming unit in a recording-medium transport direction and that forms a black toner image on a second intermediate transfer unit; a first transfer part that transfers the superimposed toner image formed on the first intermediate transfer unit by the first forming unit to a recording medium; and a second transfer part that is located downstream of the first transfer part in the recording-medium transport direction and that transfers, in a superimposed manner, the black toner image formed on the second intermediate transfer unit by the second forming unit to the superimposed toner image on the recording medium.

11 Claims, 5 Drawing Sheets

IMAGE FORMING APPARATUS HAVING MULTIPLE IMAGE FORMING UNITS

CROSS-REFERENCE TO RELATED APPLICATIONS

This application is based on and claims priority under 35 USC 119 from Japanese Patent Application No. 2018-178349 filed Sep. 25, 2018.

BACKGROUND

(i) Technical Field

The present disclosure relates to an image forming apparatus.

(ii) Related Art

Japanese Unexamined Patent Application Publication No. 2007-310226 discloses a technique for efficiently cooling multiple image carriers without increasing the size of an image forming apparatus.

SUMMARY

Aspects of non-limiting embodiments of the present disclosure relate to increasing the coverage, per unit area, of a recording medium with toner, compared with a configuration in which a toner image is second-transferred to a recording medium only once.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a first forming unit that forms a superimposed toner image, in which yellow, magenta, and cyan toner images are superimposed on one another, on a first intermediate transfer unit; a second forming unit that is located downstream of the first forming unit in a recording-medium transport direction and that forms a black toner image on a second intermediate transfer unit; a first transfer part that transfers the superimposed toner image formed on the first intermediate transfer unit by the first forming unit to a recording medium; and a second transfer part that is located downstream of the first transfer part in the recording-medium transport direction and that transfers, in a superimposed manner, the black toner image formed on the second intermediate transfer unit by the second forming unit to the superimposed toner image on the recording medium.

BRIEF DESCRIPTION OF THE DRAWINGS

An exemplary embodiment of the present disclosure will be described in detail based on the following figures, wherein.

DETAILED DESCRIPTION

The directions used in the following description of an image forming apparatus 10 according to an exemplary embodiment of the present disclosure are based on the image forming apparatus 10. Specifically, the width, height, and depth directions of the image forming apparatus 10 shown in FIG. 1 will be referred to as X, Y, and Z directions, respectively. When one side and the other side in the X, Y, and Z directions need to be distinguished, the right, left, upper, lower, front, and rear sides of the image forming apparatus 10 shown in FIG. 1 will be referred to as +X, −X, +Y, −Y, +Z, and −Z sides, respectively. In this exemplary embodiment, a recording sheet P is used as an example of a recording medium. The image forming apparatus 10 according to this exemplary embodiment employs a so-called single-path method, in which a recording sheet P passes through image forming units 18 (described below) only once during printing.

Configuration of Image Forming Apparatus

Figure 1:
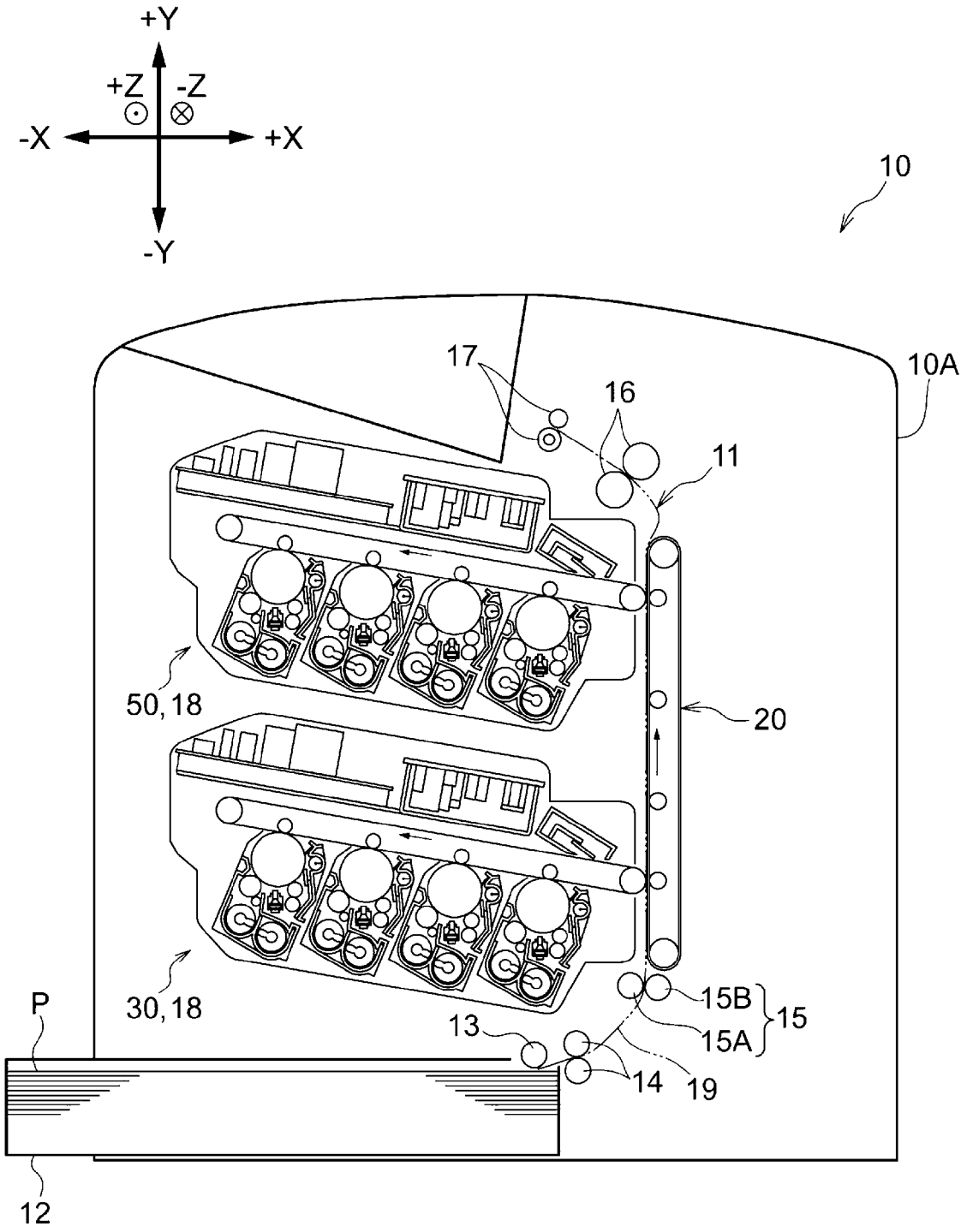
FIG. 1 is a front view of an image forming apparatus according to an exemplary embodiment of the present disclosure.

As shown in FIG. 1, the image forming apparatus 10 includes a container 12 that accommodates recording sheets P, a transport unit 11 that transports a recording sheet P, and the image forming units 18 that form toner images to be transferred to the recording sheet P.

The container 12 accommodates recording sheets P and can be pulled out of an image forming apparatus body 10A of the image forming apparatus 10.

The transport unit 11 includes, in this order from the upstream side in a sheet-transport direction, a feed roller 13, transport rollers 14, a registration roller pair 15, a transport belt 20, fixing rollers 16, and output rollers 17.

The feed roller 13 feeds one of the recording sheets P in the container 12 to a transport path 19, which constitutes the transport unit 11.

The transport rollers 14 transport the recording sheet P along the transport path 19.

The registration roller pair 15 transports the recording sheet P transported by the transport rollers 14 to a nip part, where the recording sheet P is nipped between a backup roller 42 and a second transfer roller 24 (described below). The registration roller pair 15 includes a registration roller 15A that comes into contact with the transfer side of a recording sheet P and a pinch roller 15B that comes into contact with the non-transfer side of the recording sheet P. The registration roller 15A is rotationally driven by a driving unit (not shown). The pinch roller 15B is in contact with (urged against) the registration roller 15A by an elastic member (not shown), such as a coil spring. Hence, the pinch roller 15B is rotated by the registration roller 15A. At the registration roller pair 15, the recording sheet P is nipped between the registration roller 15A and the pinch roller 15B and is transported downstream in the sheet-transport direction.

The transport belt 20 transports the recording sheet P downstream in the sheet-transport direction, along the transport path 19, during which toner images formed by the image forming units 18 are transferred to the recording sheet P. The details of the transport belt 20 will be described below.

The fixing rollers 16 apply heat and pressure to the recording sheet P, to which the toner image has been transferred, to fix the toner image to the recording sheet P.

The output rollers 17 output the recording sheet P, to which the toner image has been fixed, to the outside of the image forming apparatus body 10A.

The image forming units 18 include a first image forming unit 30 located on the upstream side in the sheet-transport direction and a second image forming unit 50 located downstream of the first image forming unit 30 in the sheet-transport direction. The image forming units 18 are an example of forming units, the first image forming unit 30 is an example of a first forming unit, and the second image forming unit 50 is an example of a second forming unit.

Figure 2:
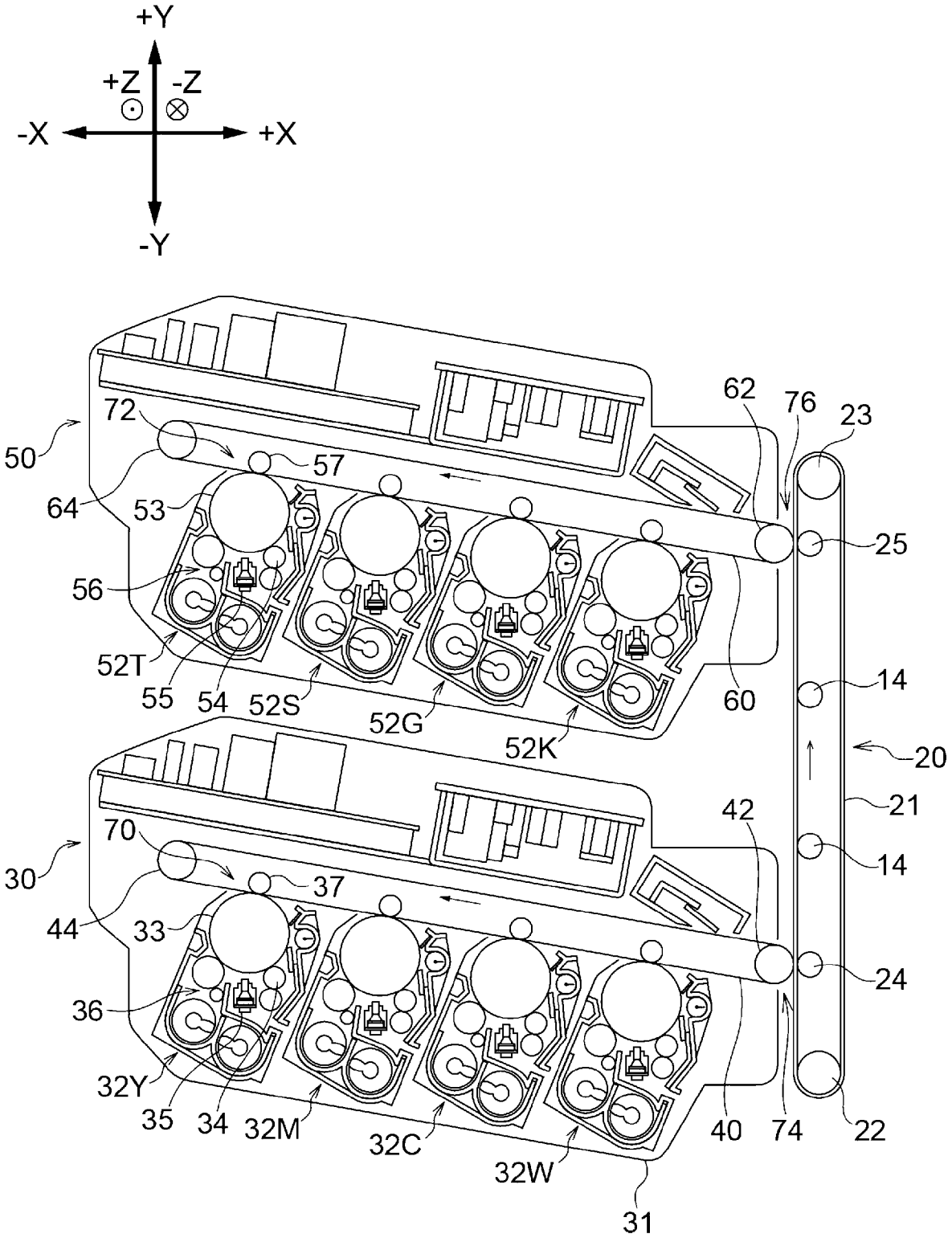
FIG. 2 is a partial enlarged view of FIG. 1.

As shown in FIG. 2, the first image forming unit 30 includes four image forming subunits 32, and an endless intermediate transfer belt 40, which carries toner images formed by the image forming subunits 32 and revolves counterclockwise in FIG. 2.

The image forming subunits 32 include: a white subunit 32W, which forms a white toner image; a magenta subunit 32M, which forms a magenta toner image; a cyan subunit 32C, which forms a cyan toner image; and a yellow subunit 32Y, which forms a yellow toner image. The yellow subunit 32Y, the magenta subunit 32M, the cyan subunit 32C, and the white subunit 32W are arranged in this order from the upstream side (i.e., the side closer to a support roller 44 described below) in the direction in which the intermediate transfer belt 40 revolves (hereinbelow, the belt-revolving direction). That is, among the image forming subunits 32, the white subunit 32W is located on the extreme downstream side in the belt-revolving direction.

When there is no need to distinguish the image forming subunits 32, the letters Y, M, C, W are omitted.

The image forming subunits 32 can be individually attached to and removed from the image forming apparatus body 10A. The image forming subunits 32 each include a photoconductor 33, a charging member 34 that charges the surface of the photoconductor 33, an exposure device 35 that irradiates the charged photoconductor 33 with exposure light to form an electrostatic latent image, and a developing device 36 that develops the electrostatic latent image into a visible toner image.

Furthermore, first transfer rollers 37 that transfer the toner images formed by the image forming subunits 32 to the intermediate transfer belt 40 are provided opposite the photoconductors 33 with the intermediate transfer belt 40 therebetween. The intermediate transfer belt 40 is stretched between the support roller 44, which supports the intermediate transfer belt 40, and the backup roller 42, which is provided at a first transfer part 74 (described below). The photoconductors 33, the first transfer rollers 37, and the intermediate transfer belt 40 constitute a first intermediate transfer unit 70.

The second image forming unit 50 includes four image forming subunits 52 and an intermediate transfer belt 60. The image forming subunits 32 and 52 are an example of forming subunits.

The image forming subunits 52 include: a black subunit 52K, which forms a black toner image; a gold subunit 52G, which forms a gold toner image; a silver subunit 52S, which forms a silver toner image; and a transparent subunit 52T, which forms a transparent toner image. The transparent subunit 52T, the silver subunit 52S, the gold subunit 52G, and the black subunit 52K are arranged in this order from the upstream side (i.e., the side closer to a support roller 64 described below) in the direction in which the intermediate transfer belt 60 revolves. That is, among the image forming subunits 52, the black subunit 52K is located on the extreme downstream side, the gold subunit 52G and the silver subunit 52S are located upstream of the black subunit 52K, and the transparent subunit 52T is located on the extreme upstream side in the belt-revolving direction.

When there is no need to distinguish the image forming subunits 52, the letters T, S, G, and K are omitted.

The image forming subunits 52 can be individually attached to and removed from the image forming apparatus body 10A. The image forming subunits 52 each include a photoconductor 53, a charging member 54, an exposure device 55, and a developing device 56. Furthermore, first transfer rollers 57 are provided opposite the photoconductors 53 with the intermediate transfer belt 60 therebetween. The intermediate transfer belt 60 is stretched between the support roller 64 and a backup roller 62, which is provided at a second transfer part 76 (described below). The photoconductors 53, the first transfer rollers 57, and the intermediate transfer belt 60 constitute a second intermediate transfer unit 72.

Furthermore, as shown in FIG. 2, the transport belt 20 is set in the image forming apparatus body 10A (see FIG. 1) so as to be able to revolve clockwise in FIG. 2. The transport belt 20 includes an endless belt part 21, support rollers 22 and 23 that support the belt part 21, the transport rollers 14, and second transfer rollers 24 and 25, which are respectively opposite the backup rollers 42 and 62 with the intermediate transfer belt 40 and the belt part 21 and the intermediate transfer belt 60 and the belt part 21 therebetween.

The second transfer roller 24 and the backup roller 42 nip a recording sheet P at a nip part formed therebetween to transfer the toner image formed by the first image forming unit 30 to the recording sheet P.

The second transfer roller 25 and the backup roller 62 nip the recording sheet P at a nip part formed therebetween to transfer the toner image formed by the second image forming unit 50 to the recording sheet P.

The backup roller 42, the second transfer roller 24, and the intermediate transfer belt 40 constitute the first transfer part 74, at which the toner image formed on the first intermediate transfer unit 70 by the first image forming unit 30 is transferred. The backup roller 62, the second transfer roller 25, and the intermediate transfer belt 60 constitute the second transfer part 76, at which the toner image formed on the second intermediate transfer unit 72 by the second image forming unit 50 is transferred.

Figure 3:
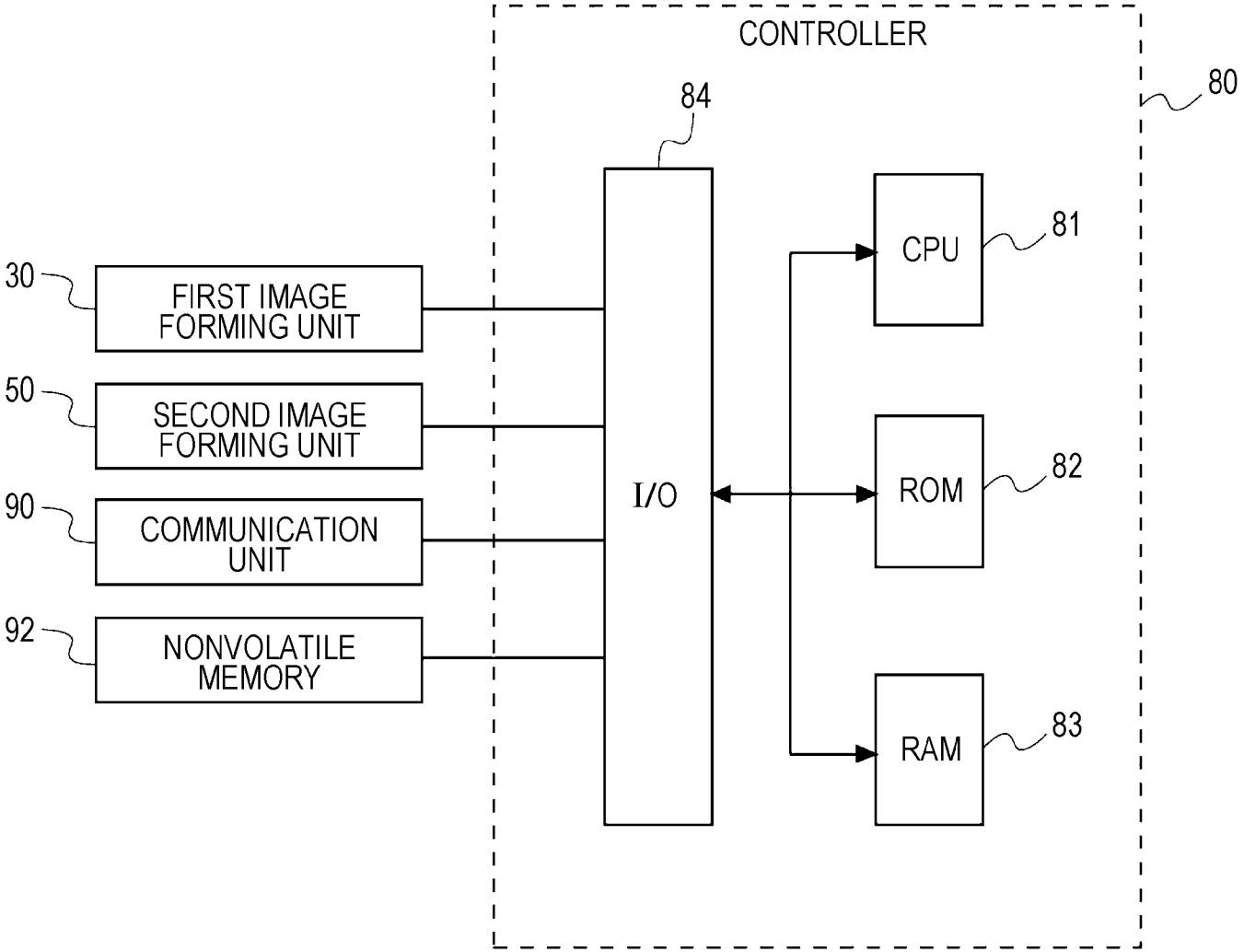
FIG. 3 is a block diagram showing the configuration of a controller and other components according to the exemplary embodiment.

Referring to FIG. 3, a controller 80 that controls the operation of the image forming apparatus 10, and components connected to the controller 80 will be described.

As shown in FIG. 3, in the controller 80, a central processing unit (CPU) 81, a read-only memory (ROM) 82, a random-access memory (RAM) 83, and an input/output interface (I/O) 84 are connected to one another via busses.

The ROM 82 stores an image forming control program (not shown) to be executed by the CPU 81. The CPU 81 reads the image forming control program out of the ROM 82 into the RAM 83 to execute printing processing by the image forming control program.

Furthermore, the first image forming unit 30, the second image forming unit 50, a communication unit 90, and a nonvolatile memory 92 are connected to the I/O 84.

The communication unit 90 is an interface via which a terminal apparatus (not shown), such as a personal computer, and the image forming apparatus 10 perform mutual data communication.

The nonvolatile memory 92 stores information necessary for the image forming apparatus 10 to perform an image forming operation.

The controller 80 performs control in which the toner image formed on the second intermediate transfer unit 72 by the second image forming unit 50 is superimposed onto the toner image that has been formed on the first intermediate transfer unit 70 by the first image forming unit 30 and has been transferred to the recording sheet P.

Operations and Effects

Next, the operations and effects of this exemplary embodiment will be described.

First, the controller 80 controls the image forming subunits 32 such that a toner image is formed on the first intermediate transfer unit 70 by the first image forming unit 30.

More specifically, the controller 80 causes a voltage to be supplied to the charging members 34 and causes the charging members 34 to uniformly charge the surfaces of the photoconductors 33 at a predetermined negative electric potential. The controller 80 then causes the exposure devices 35 to irradiate the surfaces of the photoconductors 33, which have been charged by the charging members 34, with the exposure light on the basis of image data obtained through the communication unit 90 to form electrostatic latent images. This way, the electrostatic latent images corresponding to the image data are formed on the surfaces of the photoconductors 33.

Next, the controller 80 develops the electrostatic latent images formed by the exposure devices 35 into visible toner images with the developing devices 36. The controller 80 causes the first transfer rollers 37 to transfer, in a superimposed manner, the toner images formed on the surfaces of the photoconductors 33 corresponding to the individual colors to the intermediate transfer belt 40. This way, a toner image, in which, for example, yellow (Y), magenta (M), cyan (C), and white (W) toner images are superimposed on one another, is formed on the first intermediate transfer unit 70 by the first image forming unit 30.

A recording sheet P fed out of the container 12 into the transport path 19 by the feed roller 13 is transported to the nip part between the backup roller 42 and the second transfer roller 24 after the timing of transportation by the registration roller pair 15 is adjusted according to the control performed by the controller 80. At the nip part, while the recording sheet P is transported between the backup roller 42 and the second transfer roller 24, the toner image on the outer circumferential surface of the intermediate transfer belt 40 is transferred to the surface of the recording sheet P. The recording sheet P, to which the toner image has been transferred, is transported to a further downstream side, in the sheet-transport direction, by the transport rollers 14 and reaches the nip part between the backup roller 62 and the second transfer roller 25.

At this time, the controller 80 adjusts the timing for the image forming subunits 52 to start image forming, so that the toner image formed on the second intermediate transfer unit 72 by the second image forming unit 50 is superimposed onto the toner image on the recording sheet P transported from the upstream side in the sheet-transport direction. Because how the image forming subunits 52 form a toner image on the second intermediate transfer unit 72 is the same as how the image forming subunits 32 form a toner image on the first intermediate transfer unit 70, the description thereof will be omitted.

How a black toner image formed on the second intermediate transfer unit 72 by the second image forming unit 50 is superimposed onto a so-called process black image, which is a black toner image formed with yellow, magenta, and cyan toners, will be described. The process black image is an example of a superimposed toner image. The image forming apparatus 10 has a black enhanced mode, in which a black toner image is superimposed onto a process black image. The black enhanced mode is performed, as necessary, by the controller 80 according to the image data obtained through the communication unit 90.

The controller 80 controls the first image forming unit 30 so as to form a process black image with the yellow subunit 32Y, the magenta subunit 32M, and the cyan subunit 32C. As a result, a process black image, in which yellow, magenta, and cyan toners are superimposed, in this order, on the intermediate transfer belt 40 is formed.

The controller 80 causes the black subunit 52K to start forming a black toner image such that the black toner image formed on the second intermediate transfer unit 72 by the second image forming unit 50 can be superimposed onto the process black image on the recording sheet P transported from the upstream side in the sheet-transport direction.

The black toner image is superimposed onto the process black image on the recording sheet P transported to the nip part between the backup roller 62 and the second transfer roller 25. The recording sheet P, which has the black toner image superimposed onto the process black image, is subjected to a fixing operation performed by the fixing rollers 16 and is output from the image forming apparatus body 10A by the output rollers 17.

In image forming apparatuses, such as printers and multifunction printers, the total amount of toner that can be transferred in single second transfer is set in advance. Hence, in an image forming apparatus in which the second transfer is performed only once, if the maximum total amount of toner m (%) that can be transferred in single second transfer is set to 100, the amount of toner that can be transferred to a recording sheet P in single printing processing is 100.

Figure 4A:
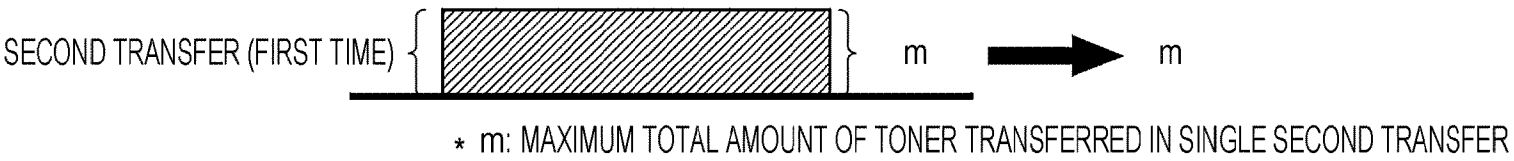
FIG. 4A shows the amount of toner transferred in a comparison configuration.

For example, as shown in FIG. 4A, in an image forming apparatus in which a toner image is second-transferred to a recording sheet P only once (comparison configuration), the total amount of toner that can be transferred in single printing processing is 100. In this comparison configuration, it is assumed that a single image forming unit includes four image forming subunits that form yellow (Y), magenta (M), cyan (C), and black (K) toner images. Accordingly, in this comparison configuration, even if a black toner image is superimposed onto a process black image in the black enhanced mode, the total amount of toner transferred is 100.

Figure 4B:
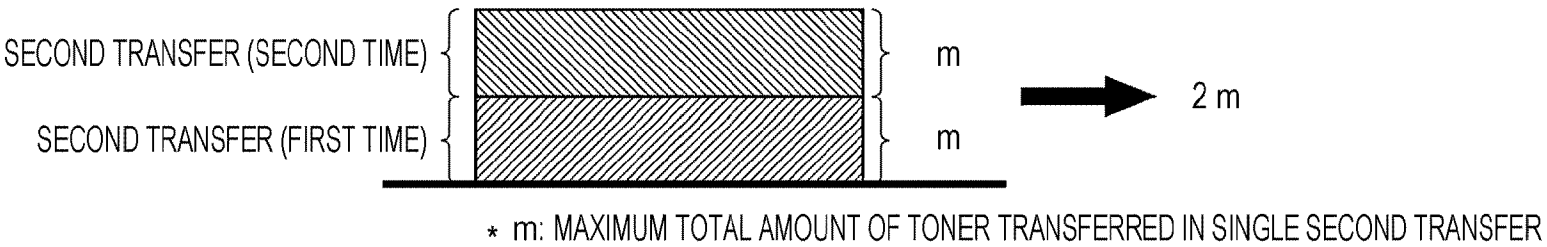
FIG. 4B shows the amount of toner transferred in the exemplary embodiment.

In contrast, in the image forming apparatus 10 according to this exemplary embodiment, as shown in FIG. 4B, the total amount of toner that can be transferred in single printing processing is 200 (m+m=2m).

As has been described above, the coverage of a recording sheet P with toner per unit area in this exemplary embodiment is higher than that in the comparison configuration. In addition, in this exemplary embodiment, a black toner image can be superimposed onto a process black image on a recording sheet P in single printing processing. Hence, a deeper and more vivid black can be reproduced, compared with the comparison configuration.

In this exemplary embodiment, it is also possible to configure such that the first image forming unit 30 forms a white toner image, and a toner image other than a white toner image (e.g., a black toner image) formed by the second image forming unit 50 is superimposed onto the white toner image. In this case, the image forming apparatus 10 has a white base mode, in which a toner image other than a white toner image is superimposed onto a white toner image. The white base mode is performed, as necessary, by the controller 80 according to the image data obtained through the communication unit 90.

In this exemplary embodiment, a toner image other than a white toner image can be superimposed onto a white toner image on a recording sheet P in single printing processing, and thus, the white toner image can be used as the base for the other toner image. In this exemplary embodiment, the total amount of toner transferred to the recording sheet P in single printing processing is 200, in which, for example, the amount of toner in the white toner image is 100, and the amount of toner in the other toner image is 100.

In contrast, in the comparison configuration in which a single image forming unit has four image forming subunits that form a white toner image and other toner images, the maximum total amount of toner transferred to the recording sheet P is 100, in which, for example, the amount of toner in the white toner image is 50, and the amount of toner in the other toner image is 50.

Accordingly, in this exemplary embodiment, because more white toner can be transferred to a recording sheet P in single printing processing than in the comparison configuration, the other toner image can be vividly reproduced, regardless of the color of the recording sheet P.

Furthermore, in this exemplary embodiment, it is also possible to configure such that the first image forming unit 30 forms a color toner image (for example, a process black image), and a transparent toner image formed by the second image forming unit 50 is superimposed onto the color toner image. In this case, the image forming apparatus 10 has a transparent coating mode in which a transparent toner image is superimposed onto the color toner image. The transparent coating mode is performed, as necessary, by the controller 80 according to the image data obtained through the communication unit 90.

According to this exemplary embodiment, it is possible to superimpose a transparent toner image onto a color toner image on a recording sheet P, that is, to cover the color toner image with the transparent toner image, in single printing processing. Accordingly, in this exemplary embodiment, it is possible to add gloss to a color toner image with a transparent toner image or to improve the design quality of the color toner image. In this exemplary embodiment, the total amount of toner transferred to a recording sheet P in single printing processing is 200, in which, for example, the amount of toner in a color toner image is 100, and the amount of toner in a transparent toner image is 100.

In contrast, in the comparison configuration in which a single image forming unit has four image forming subunits that form a color toner image and a transparent toner image, the maximum total amount of toner transferred to a recording sheet P is 100, in which, for example, the amount of toner in the color toner image is 50, and the amount of toner in the transparent toner image is 50.

In this exemplary embodiment, because it is possible to transfer more transparent toner to a recording sheet P in single printing processing than in the comparison configuration, it is possible to add more gloss to the image or to improve the design quality, compared with the comparison configuration.

As described above, the image forming apparatus body 10A has multiple image forming units 18, including the first image forming unit 30 and the second image forming unit 50. More specifically, in this exemplary embodiment, the image forming apparatus body 10A has two image forming units 18. Among the multiple image forming units 18, the first image forming unit 30 is located on the extreme upstream side, and the second image forming unit 50 is located on the extreme on the downstream side in the sheet-transport direction.

Accordingly, in this exemplary embodiment, it is possible to form, for example, a white toner image below the toner image transferred to a recording sheet P by the second image forming unit 50. Furthermore, it is possible to form, for example, a transparent toner image above the toner image transferred to a recording sheet P by the first image forming unit 30.

Figure 5:
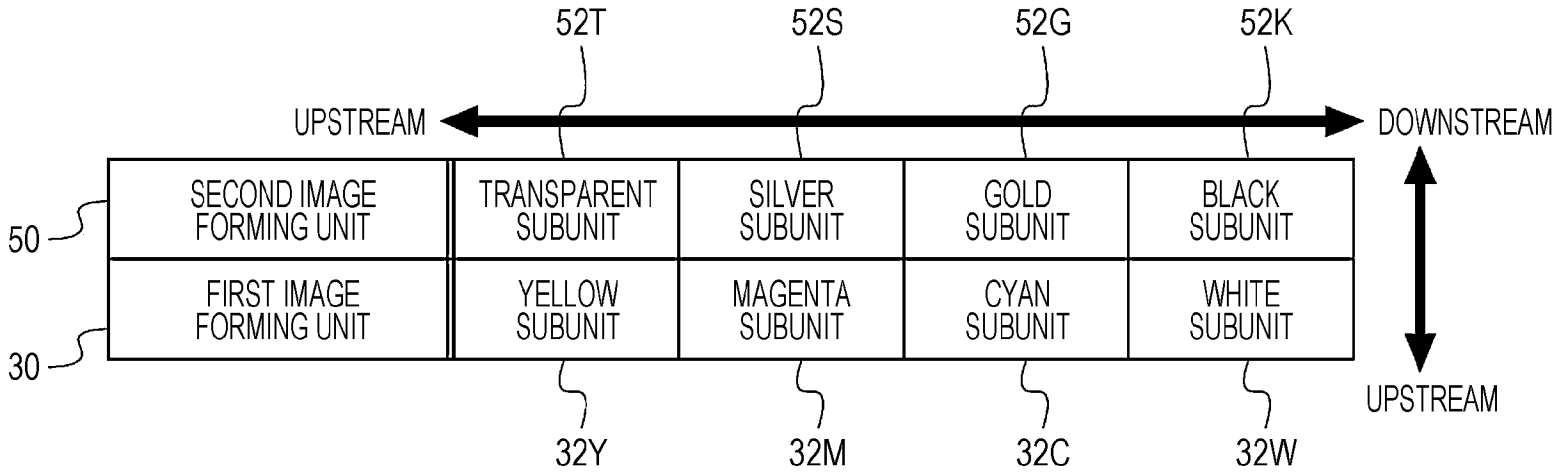
FIG. 5 shows the arrangement order of image forming subunits according to the exemplary embodiment.

Furthermore, as shown in FIG. 5, the white subunit 32W is located on the extreme downstream side in the belt-revolving direction among the multiple image forming subunits 32 in the first image forming unit 30. Hence, in this exemplary embodiment, it is possible to transfer a white toner image formed by the white subunit 32W as the bottom layer on the recording sheet P, so that the white toner image serves as the base for all the other toner images.

Furthermore, as shown in FIG. 5, the transparent subunit 52T is located on the extreme upstream side in the belt-revolving direction among the multiple image forming subunits 52 in the second image forming unit 50. Hence, in this exemplary embodiment, it is possible to transfer a transparent toner image formed by the transparent subunit 52T last as the top layer on the recording sheet P, so that the transparent toner image serves as the top coating of all the other toner images.

Furthermore, as shown in FIG. 5, the black subunit 52K is located on the extreme downstream side in the belt-revolving direction among the multiple image forming subunits 52 of the second image forming unit 50. Hence, in this exemplary embodiment, it is possible to transfer a black toner image formed by the black subunit 52K as the bottom layer of the toner images transferred to the recording sheet P in the second image forming unit 50.

Furthermore, as shown in FIG. 5, in the multiple image forming subunits 52 of the second image forming unit 50, the gold subunit 52G and the silver subunit 52S are located upstream of the black subunit 52K in the belt-revolving direction. As described above, the second image forming unit 50 is located downstream of the first image forming unit 30 in the sheet-transport direction. Hence, in this exemplary embodiment, it is possible to form the gold and silver toner images on yellow, magenta, cyan, and black toner images. By using the yellow, magenta, cyan, and black toner images as the base of the gold and silver toner images, it is possible to reproduce a sparkling, metallic color. More specifically, in this configuration, the gold and silver toners are diffused. Hence, it is possible to reproduce a particle-textured metallic color, such as the one used for a car paint.

In this exemplary embodiment, in the first image forming unit 30 and the second image forming unit 50, the image forming subunits 32 and 52 corresponding to less visible toners are located on the extreme upstream side in the multiple image forming subunits 32 and 52 in the belt-revolving direction.

When a toner image is second-transferred, for example, residual toner remaining without being fully transferred may soil a recording sheet P, resulting in an image defect. It is also known that this problem often occurs with the toner images that are second-transferred last among the toner images formed by the multiple image forming subunits 32 and 52. Hence, the toner images that are formed by the image forming subunits 32 and 52 located on the extreme upstream side in the belt-revolving direction, among the multiple image forming subunits 32 and 52, are likely to remain without being fully transferred.

To counter this problem, in this exemplary embodiment, the yellow subunit 32Y is located on the extreme upstream side in the belt-revolving direction among the multiple image forming subunits 32, and the transparent subunit 52T is located on the extreme upstream side in the belt-revolving direction among the multiple image forming subunits 52. Accordingly, in this exemplary embodiment, compared with the configuration in which the image forming units corresponding to highly visible toners are located on the extreme upstream side in the belt-revolving direction among the multiple image forming units, image defects are less noticeable, and image defects related to the transfer are suppressed.

Other Configurations

In the above-described exemplary embodiment, two image forming units, namely, the first image forming unit 30 and the second image forming unit 50, serving as the multiple image forming units 18, are provided in the image forming apparatus body 10A. However, three or more image forming units 18 may be provided in the image forming apparatus body 10A. When three or more image forming units 18 are provided in the image forming apparatus body 10A, the total amount of toner that can be transferred in single printing processing is 300 or more, and in that case, the coverage of a recording sheet P with toner per unit area can be made even higher.

In the above-described exemplary embodiment, the first image forming unit 30 includes the white subunit 32W, the magenta subunit 32M, the cyan subunit 32C, and the yellow subunit 32Y, serving as the multiple image forming subunits 32, and the second image forming unit 50 includes the black subunit 52K, the gold subunit 52G, the silver subunit 52S, and the transparent subunit 52T, serving as the multiple image forming subunits 52. In the above-described exemplary embodiment, the image forming subunits 32 and 52 in the first image forming unit 30 and the second image forming unit 50 form different color toner images. However, some of the image forming subunits 32 and 52 in the first image forming unit 30 and the second image forming unit 50 may form the toner images of the same color.

For example, the first image forming unit 30 may include, as the multiple image forming subunits 32, a black subunit K, a gold subunit G, a silver subunit S, and a transparent subunit T, and the second image forming unit 50 may include, as the multiple image forming subunits 52, the black subunit 52K, the gold subunit 52G, the silver subunit 52S, and the transparent subunit 52T. With this configuration, it is possible to superimpose a black toner image formed by the second image forming unit 50 onto a black toner image formed by the first image forming unit 30.

Furthermore, the first image forming unit 30 may include, as the multiple image forming subunits 32, the white subunit 32W, the magenta subunit 32M, the cyan subunit 32C, and the yellow subunit 32Y, and the second image forming unit 50 may include, as the multiple image forming subunits 52, a white subunit W, a magenta subunit M, a cyan subunit C, and a yellow subunit Y. With this configuration, it is possible to superimpose a process black image formed by the second image forming unit 50 onto a process black image formed by the first image forming unit 30.

In the above-described exemplary embodiment, the image forming subunits 32 and 52 in the image forming units 18 are arranged so as to be inclined with respect to the X direction. However, the image forming subunits 32 and 52 may be arranged in a line in the X direction so as to be parallel to the X direction or may be arranged in a line in the Y direction so as to be perpendicular to the X direction.

In the configuration of the above-described exemplary embodiment, the first image forming unit 30 and the second image forming unit 50 are arranged in a line in the Y direction so as to be perpendicular to the X direction (so as to be one on top of the other) so that a recording sheet P is transported in the Y direction. However, it is also possible to configure such that the first image forming unit 30 and the second image forming unit 50 are arranged in a line in the X direction so as to be parallel to the X direction (so as to be side-by-side) so that a recording sheet P is transported in the X direction.

The foregoing description of the exemplary embodiment of the present disclosure has been provided for the purposes of illustration and description. It is not intended to be exhaustive or to limit the disclosure to the precise forms disclosed. Obviously, many modifications and variations will be apparent to practitioners skilled in the art. The embodiment was chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a first forming unit that forms a superimposed toner image, in which yellow, magenta, and cyan toner images are superimposed on one another, on a first intermediate transfer unit;

a second forming unit that is located downstream of the first forming unit in a recording-medium transport direction and that forms a black toner image on a second intermediate transfer unit;

a first transfer part that transfers the superimposed toner image formed on the first intermediate transfer unit by the first forming unit to a recording medium; and a second transfer part that is located downstream of the first transfer part in the recording-medium transport direction and that transfers, in a superimposed manner, the black toner image formed on the second intermediate transfer unit by the second forming unit to the superimposed toner image on the recording medium, wherein the first forming unit includes a white subunit that forms a white toner image on the first intermediate transfer unit.

2. The image forming apparatus according to claim 1, wherein the second forming unit includes a transparent subunit that forms a transparent toner image on the second intermediate transfer unit.

3. The image forming apparatus according to claim 1, wherein the second forming unit includes a plurality of forming subunits including a black subunit that forms the black toner image on the second intermediate transfer unit, and the black subunit is located on an extreme downstream side of the plurality of forming subunits in the direction in which the second intermediate transfer unit revolves.

4. An image forming apparatus comprising:

a first forming unit that forms a white toner image on a first intermediate transfer unit;

a second forming unit that is located downstream of the first forming unit in a recording-medium transport direction and that forms another toner image of a color other than white on a second intermediate transfer unit;

a first transfer part that transfers the white toner image formed on the first intermediate transfer unit by the first forming unit to a recording medium; and a second transfer part that is located downstream of the first transfer part in the recording-medium transport direction and that transfers, in a superimposed manner, the other toner image formed on the second intermediate transfer unit by the second forming unit to the white toner image on the recording medium.

5. The image forming apparatus according to claim 4, wherein the image forming apparatus includes a plurality of forming units including the first forming unit and the second forming unit, and the first forming unit is located on an extreme upstream side of the plurality of forming units in the recording-medium transport direction.

6. The image forming apparatus according to claim 5, wherein the first forming unit includes a plurality of forming subunits including a white subunit, which forms the white toner image on the first intermediate transfer unit, and the white subunit is located on an extreme downstream side of the plurality of forming subunits in a direction in which the first intermediate transfer unit revolves.

7. An image forming apparatus comprising:

a first forming unit that forms a color toner image on a first intermediate transfer unit;

a second forming unit that is located downstream of the first forming unit in a recording-medium transport direction and that forms a transparent toner image on a second intermediate transfer unit;

a first transfer part that transfers the color toner image formed on the first intermediate transfer unit by the first forming unit to a recording medium; and a second transfer part that is located downstream of the first transfer part in the recording-medium transport direction and that transfers, in a superimposed manner, the transparent toner image formed on the second intermediate transfer unit by the second forming unit to the color toner image on the recording medium.

8. The image forming apparatus according to claim 7, wherein the second forming unit includes a plurality of forming subunits including a transparent subunit, which forms the transparent toner image on the second intermediate transfer unit, and the transparent subunit is located on an extreme upstream side of the plurality of forming subunits in a direction in which the second intermediate transfer unit revolves.

9. The image forming apparatus according to claim 8, wherein the image forming apparatus includes a plurality of forming units including the first forming unit and the second forming unit, and the second forming unit is located on an extreme downstream side of the plurality of forming units in the recording-medium transport direction.

10. The image forming apparatus according to claim 7, wherein the first forming unit includes a plurality of forming subunits including a yellow subunit that forms a yellow toner image on the first intermediate transfer unit, a magenta subunit that forms a magenta toner image on the first intermediate transfer unit, and a cyan subunit that forms a cyan toner image on the first intermediate transfer unit, and the second forming unit includes a plurality of forming subunits including a black subunit that forms a black toner image on the second intermediate transfer unit, a gold subunit that forms a gold toner image on the second intermediate transfer unit, and a silver subunit that forms a silver toner image on the second intermediate transfer unit, the gold subunit and the silver subunit being located upstream of the black subunit in the direction in which the second intermediate transfer unit revolves.

11. The image forming apparatus according to claim 10, wherein, in the first forming unit and the second forming unit, forming subunits corresponding to less visible toners are located on an extreme upstream side of the plurality of forming subunits in the direction in which the first intermediate transfer unit and the second intermediate transfer unit revolve.

* * * * *